United States Patent [19]

Clarke et al.

[11] 3,967,227

[45] June 29, 1976

[54] ACTUATOR SYSTEM WITH AMBIENT TEMPERATURE COMPENSATION

[75] Inventors: David E. Clarke, Attleboro; Robert P. Lackey, North Attleboro; Joel P. Clark, Plainville, all of Mass.

[73] Assignee: Texas Instruments Incorporated, Dallas, Tex.

[22] Filed: Jan. 10, 1975

[21] Appl. No.: 535,940

[52] U.S. Cl. ..... 337/124; 337/140

[51] Int. Cl.[2] ..... H01H 71/22

[58] Field of Search ..... 337/124, 123, 140, 378

[56] References Cited

UNITED STATES PATENTS

| | | | |
|---|---|---|---|
| 2,486,714 | 11/1949 | Koci | 337/378 |
| 3,218,411 | 11/1965 | Silberg | 337/124 |
| 3,634,803 | 1/1972 | Willson et al. | 337/123 |
| 3,652,969 | 3/1972 | Willson et al. | 337/140 |
| 3,858,141 | 12/1974 | Lackey | 337/140 |

FOREIGN PATENTS OR APPLICATIONS

| | | | |
|---|---|---|---|
| 609,916 | 12/1960 | Canada | 337/124 |

*Primary Examiner*—Harold Broome
*Attorney, Agent, or Firm*—John A. Haug; James P. McAndrews; Russell E. Baumann

[57] ABSTRACT

An actuator system for use in an electrical relay or the like. An actuator member is carried by a frame and is movable between a first and a second position, being biased toward its first position by a spring and having an actuating wire coupled between it and the frame. This wire is stretched from its original length to a second length by the spring when the actuator member is in its first position. The wire is of a selected metal alloy which, upon being heated, shortens its length and thus causes the tension in the wire to increase an amount sufficient to overcome the bias of the spring and to move the actuator member towards its second position. The actuator system further includes selectively operable heating means for the wire and an ambient temperature compensator for insuring that upon operation of the heating means, the wire is sufficiently heated to effect movement of the actuating member from its first to its second position and for preventing the wire from being overstressed, regardless of changes in ambient temperature within a limited range.

21 Claims, 11 Drawing Figures

ACTUATOR SYSTEM WITH AMBIENT TEMPERATURE COMPENSATION

BACKGROUND OF THE INVENTION

This invention relates to an actuator system, and more particularly to such a system which is ambient temperature conpensated and useful, for example, as an electrical relay which may be actuated at low power levels.

Specifically, known relay actuator systems in the field of this invention have used a length of a special alloy actuating wire (e.g., a nickel-titanium alloy such as Nitinol) which when stretched from its original length to a second length by a spring or the like and heated above an actuation temperature undergoes a change in its modulus of elasticity from a relatively low value (e.g. $3\times10^6$ psi or $2.07\times10^{10}$ N/m$^2$) to a relatively high value (e.g., $12\times10^6$ psi or $8.27\times10^{10}$ N/m$^2$). This change in modulus of elasticity causes the length of the wire to shrink from its second length to its original length thus causing an increase in tension in the wire which acts to move an actuator arm or the like. Upon cooling, the wire is again stretched back to its second length by the spring. Reference may be made to U.S. Pat. Nos. 3,634,803 and 3,652,969 which illustrate known relay actuator systems in the same general field as the present invention.

While these prior art relay actuator systems offer many advantages, changes in ambient temperature cause problems. For example, upon ambient temperature increasing from room temperature to a higher ambient temperature, this higher ambient temperature being below the above-mentioned actuation temperature, the length of the wire would gradually shrink or contract thus causing the contacts of the relay to creep closed (or open). Also, upon energizing the wire at high ambient temperatures with a constant current at the power level required to insure actuation of the relay at normal or low ambient temperatures, the wire could be heated appreciably above the above-mentioned actuation temperature. It has been found that overheating the wire above the actuation temperature may significantly reduce the operating life of the relay actuator system and may cause system failure.

SUMMARY OF THE INVENTION

Among the several objects of the present invention may be noted the provision of an actuator system, such as a relay actuator system, as above described which compensates for changes in ambient temperature (within a limited range) and prevents damage to the system; the provision of such an actuator system which maintains the actuating wire under substantially constant tension upon changes of ambient temperature within a predetermined ambient temperature range so as to prevent the relay switch contacts from creeping open or closed; the provision of such an actuator system which prevents the actuating wire from being overstressed when it is energized at high ambient temperatures; and the provision of such an actuator system which is reliable in operation at both high and low ambient temperatures and which is economical to manufacture. Other objects and features of this invention will be in part apparent and in part pointed out hereinafter.

Briefly, an actuator system of this invention comprises a frame, an actuator member carried by the frame movable between a first position and a second position, and means biasing the actuator member toward its first position. A wire is coupled between the frame and the actuator member, this wire being tensioned by the biasing means so as to deform or stretch the wire from an original length to a second length when the actuator member is in its first position. This wire is of a selected metal alloy which upon being heated shortens its length and thus causes the tension in the wire to increase an amount sufficient to overcome the bias of the biasing means and to thus move the actuator member from its first to its second position. Means are provided for selectively heating the wire to effect the above-mentioned increase of the wire. Other means are provided responsive to changes in ambient temperature for insuring that upon operation of the heating means the wire is sufficiently heated to effect a change in tension therein for moving the actuating member from its first to its second position and for preventing the wire from being overstressed.

BRIEF DESCRIPTION OF THE DRAWINGS

Other corresponding reference characters illustrate corresponding parts throughout the several views of the drawings.

DESCRIPTION OF PREFERRED EMBODIMENTS

Figure 1:
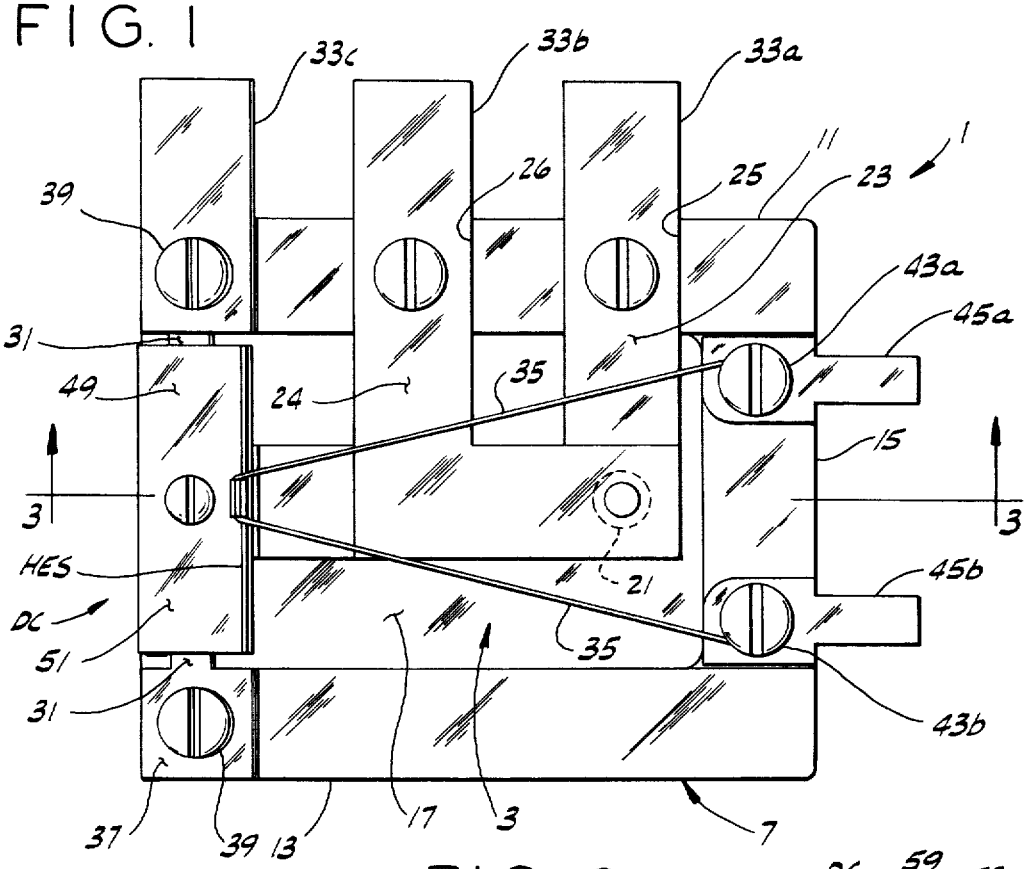
FIG. 1 is a plan view of an electrical relay including an actuator system of the present invention.

Referring now to the drawings, an electrical relay indicated in its entirety at 1 is shown to have an actuator system 3 which, in accordance with the present invention, is compensated for changes in ambient temperature.

Figure 2:
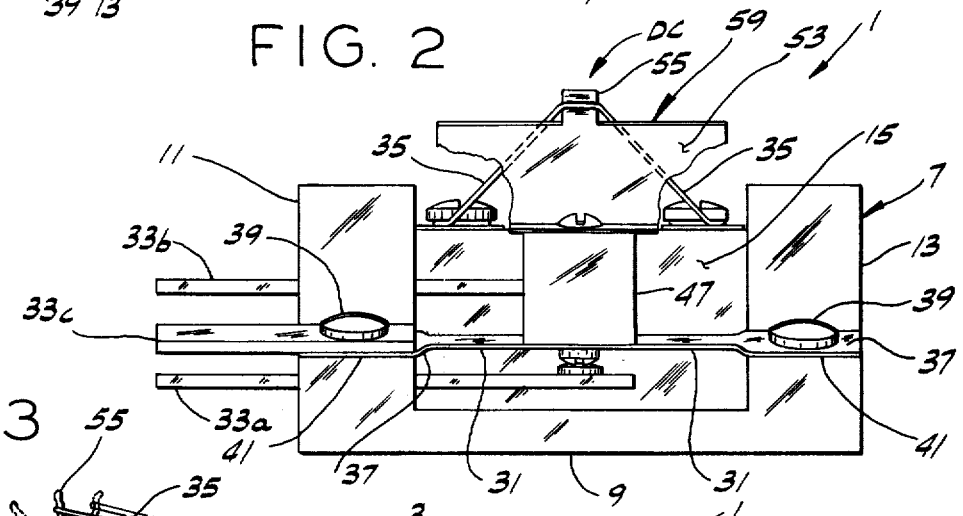
FIG. 2 is a left end view of FIG. 1.
Figure 3:
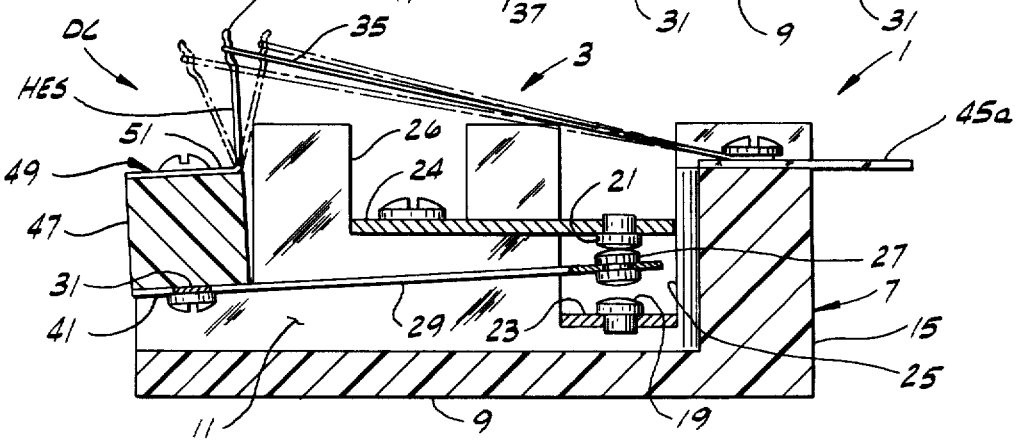
FIG. 3 is a vertical cross section taken on line 3—3 of FIG. 1 illustrating a bimetallic ambient temperature compensation member in its room temperature position (shown in solid lines), and further illustrating both cold and hot ambient temperature positions of the bimetallic member (shown in phantom)

More particularly, relay 1 comprises a rigid, insulative base or frame 7 of a synthetic resin material, such as a molded phenolic. As shown in FIGS. 1–3, the frame has a flat bottom 9 having a pair of side walls 11 and 13 and an end wall 15 extending up from the bottom forming a U-shaped opening 17 (as viewed in FIG. 1) open at its top and at one end opposite wall 15. Stationary contacts 19 and 21 are secured to frame 7 and are supported in spaced relation within opening 17 by contact supports 23 and 24, respectively. As best shown in FIG. 3, wall 11 is notched as indicated at 25 and 26 for respectively receiving contact supports 23 and 24. It will be noted that notch 25 is somewhat deeper than notch 26 thereby insuring that contacts 19 and 21 are spaced vertically from one another. A movable double faced contact 27 is carried at the free end of a movable contact or actuator arm 29, the latter being movable between a first position (as shown in FIG. 3) in which the upper face of contact 27 is in engagement with stationary contact 21 and a second position (not shown) in which the lower contact face of contact 27 is in engagement with contact 19. The contact arm is cantilevered by a pair of torsion springs 31, one on each side of the arm at one end of the arm for biasing the arm and movable contact 27 into engagement with contact 21, these torsion springs constituting a pivot axis for the contact arm as it moves between its first and second positions. Terminals 33*a*, 33*b* and 33*c* are provided for contacts 19, 21 and 27, respectively. As shown in the drawings, relay 1 is single-pole, double-throw (SPDT). With contact arm 29 in the position shown in FIG. 3 with actuator system 3 deenergized, and with only terminals 33*a* and 33*c* connected to a load, contact 21 can be considered as a stop for movable contact 27 and the above-mentioned first position of contact 29 can be considered as an open circuit position and the second position as a closed circuit position for the purposes of the following description.

The actuator system 3 is shown to comprise an actuator wire 35 coupled between wall 15 of frame 7 and actuator arm 29. Actuator wire 35 is stretched from an original length (which is typically about 0.50 to 0.75 percent shorter than the length of the wire shown in solid lines in FIG. 3) to a second length (generally corresponding to the length of the wire shown in solid lines in FIG. 3) by torsion springs 31 when actuator arm 29 is in its first position. Wire 35 is of a selected metal alloy, as will be described hereinafter, which upon being heated shortens its length and thus causes the tension in the wire to increase an amount sufficient to overcome the bias of springs 31 and to move actuator arm 29 from its first position to its second position.

As shown in FIGS. 1–6, actuator arm 29 and torsion springs 31 form an integral T-shaped flat member. Preferably, this T-shaped member is formed of a thin, resilient, electrically conductive alloy, such as beryllium copper or the like. The torsion springs 31 each have a mounting tab 37 at their outer ends for securement of the T-shaped member to base 7 by screws 39. As best shown in FIGS. 2 and 3, walls 11 and 13 each have shoulders 41 adjacent the open end of opening 17, these shoulders being inclined relative to bottom 9 of base 7 with the ends of these shoulders toward wall 15 higher than their other end. Thus, upon mounting the T-shaped member in frame 7, it normally assumes a neutral position generally at the incline of shoulders 41 such that if contact 27 were not engaged by stationary contact 21, contact arm 29 would be inclined somewhat above its position shown in FIG. 3. Thus, with the contact arm in its first position as shown in FIG. 3, an initial bias force is induced in the torsion springs thereby to positively maintain contacts 27 and 21 in engagement with one another and to provide a bias force which stretches actuator wire 35 from its original length to its stated second length and which the wire must overcome before contact 27 begins to move toward contact 19. It will also be noted that upon pivotal movement of contact arm 29 from its first to its second position, increased torsion is applied to arm 29 by springs 31. The slope shoulders 41 in walls 11 and 13 permit the flat T-shaped member to be directly installed by frame 7 without the necessity of preforming or twisting torsion springs 31. As best shown in FIGS. 1 and 2, terminal 33*c* overlies spring mounting tab 37, extends beyond side wall 11 and is secured to frame 7 by screw 39. Wire 35 is shown to be doubled and anchored at its ends to wall 15 by means of screws 43*a*, 43*b* and coupled to actuator arm 29 adjacent the pivotal axis of torsion springs 31. Screws 43*a*, 43*b* are each in electrical connection with a respective electrical terminal 45*a*, 45*b* and the wire thus constitutes a conductor path between the terminals. Each of these terminals is adapted for electrical connection to a control circuit for passing a current through the wire for self-heating the wire to a temperature sufficient to effect a change in tension in the wire and to overcome the bias of torsion springs 31 and to thus effect movement of contact arm 29 from its first to its second position. While wire 35 is shown to be a self-heating wire requiring only that a current be passed therethrough, it will be understood that other heating means may be provided for the wire, including, for example, a heating coil wrapped around the wire.

More particularly, wire 35 is preferably a selected nickel-titanium alloy, commonly referred to as Nitinol, having a composition by weight from about 54–56 percent nickel and the balance titanium. As this alloy is well known, it is not described in detail herein. It will be understood that when this alloy is stretched about 4 percent, it has a relatively low modulus of eleasticity (e.g., $3\times10^6$ psi or $2.07\times10^{10}$ N/m$^2$) at room temperature, and a relatively higher modulus of elasticity (e.g., $12\times10^6$ psi or $8.27\times10^{10}$ N/m$^2$) when the wire is heated above a transition temperature, and that this change is reversible upon cooling of the wire. When properly conditioned in a well known manner, wire 35 displays shape-memory properties. That is, when the wire is deformed (i.e., stretched) so as to increase its length, the wire will shorten and return to its original length (if permitted to move) when it is heated. Wire 35 is circular in cross section, having a diameter for example of about 0.002 inch (0.05 mm.) and a total length of about 2 inches (51 mm.). Thus, when a control current is supplied to terminals 45*a*, 45*b* and passes through the wire, it self-heats to a temperature sufficient to effect the above-mentioned change in modulus of elasticity in a relatively short time (e.g., a matter of milli-seconds). Thus, contact arm 29 may be abruptly moved from its first to its second position. Furthermore, because of the small mass of wire 35, it may rapidly be heated to its activation temperature by a control current of relatively low level. For example, an actuator wire dimensioned as above-described and incorporated in the relay as shown in the drawings may be actuated by a current having a power level below two watts and preferably below about 0.5 watts, and the actuator system 3 displays high gain. This gain may range from between 500:1 and 10,000:1. While the actuator system 3 shown in the drawings incorporated in a relay may be used for a variety of actuator functions other than as an actuator system for an electrical relay, it is particularly advantageous when used in a relay because of the high gain of the actuator system. For example, actuator system 3 can be utilized as a relay powered directly by the lower power levels generated by certain integrated circuits to switch high current and high voltages, typically 30 amperes at 12 volts across contacts 19 and 21).

In accordance with this invention, actuator system 3 includes compensation means responsive to changes in ambient temperature for insuring that upon energization of actuator wire 35 it is sufficiently heated to effect a change in tension in the actuator wire for moving arm 29 from its first to its second position and for preventing the actuator wire from being overstressed when the actuator system is actuated at any temperature within its ambient temperature operating range. A first embodiment of this ambient temperature compensation means is indicated generally at DC in FIGS. 1–3 and is generally referred to as device compensation.

More particularly, ambient temperature compensation means DC is shown to comprise an insulative spacer 47 secured to the top face of arm 29 adjacent the pivot axis of torsion springs 31 and an L-shaped bimetallic bracket 49 secured to the top of the spacer. The bracket has a base 51 and an upstanding leg 52 projecting up generally perpendiularly to the base. The vertical leg has a finger 55 extending above the topmost edge thereof and constitutes a support to which wire 35 is coupled. Thus, with wire 35 anchored to wall 51 by screws **43*a*, 43*b* and coupled to finger 55, it will be seen that spacer 47 electrically insulates the wire from arm 29, and the spacer and bracket together constitute a crank or lever arm for arm 29 so that upon an increase in tension in the wire increased torque is applied to springs 31 which overcomes the bias of the springs and effects movement of arm 29 from its first to its second position. It will be noted that bracket 49 is wide in relation to its height and that the high expansion side HES of leg 53 faces away from wall 15 so as to insure that leg 53 flexes in the longitudinal direction of wire 35 toward and away from wall 15 in response to changes in ambient temperature. In FIG. 3, the normal room temperature position of leg 53 is shown in solid lines. Upon exposure to a lower ambient temperature condition, leg 53 flexes away from wall 15 to make the effective length of wire 35 greater than its normal room temperature length, and upon increases in ambient temperature, the leg flexes in the opposite direction to shorten the effective length of the wire. Thus, within a limited temperature range, for example, 0°F. (−18°C.) to 160°F. (71°C.), wire 35** is maintained under substantially constant tension.

Figure 4:
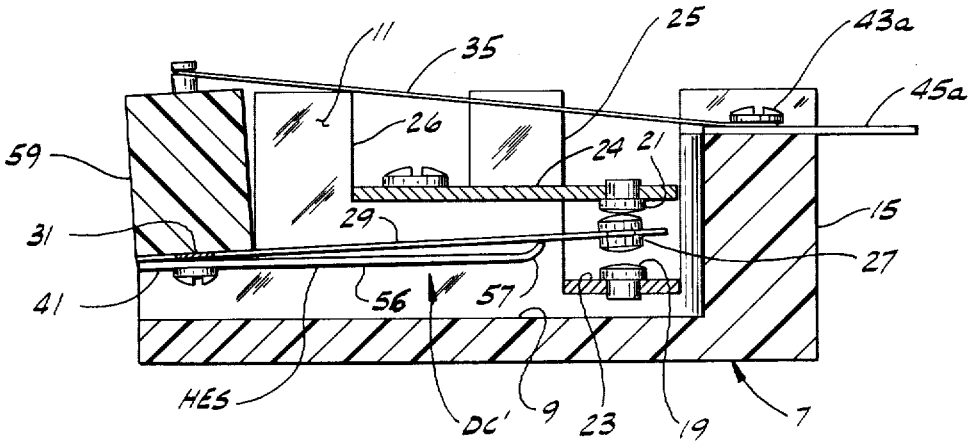
FIG. 4 is a view similar to FIG. 3 illustrating another embodiment with a different bimetallic ambient temperature compensation member.
Figure 5:
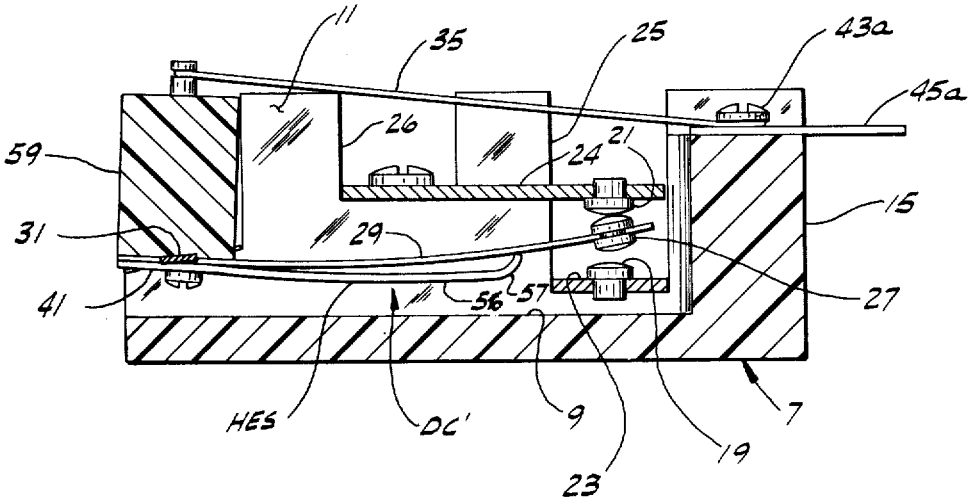
FIGS. 5 and 6 are similar to FIG. 4 and illustrate high and low ambient temperature positions, respectively, of the bimetallic member of FIG. 4.
Figure 6:
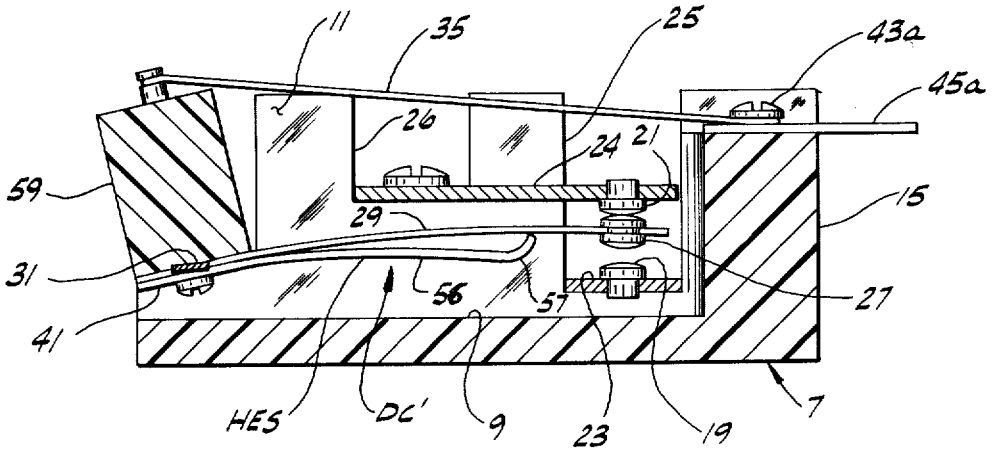

In FIGS. 4–6, another embodiment of device ambient temperature compensation means is indicated generally at DC′ in which an elongate bimetallic finger 56 is secured at one of its ends to the bottom face of arm 29 adjacent the pivot axis of springs 31. Bimetal finger 56 extends generally lengthwise of arm 29 toward contact 27, but terminates short thereof. This bimetal finger has an upturned outer end portion 57 engageable with the bottom face of arm 29 so that the bimetal finger is spaced from arm 29 substantially along its length intermediate its securement to arm 29 and its end portion 57. This bimetal finger is arranged with its high expansion side HES facing away from the bottom face of arm 29. An insulative post 59 is secured to the upper face of arm 29 adjacent the pivot axis of springs 31 and extends generally perpendicularly therefrom. Wire 35 is secured to the upper end of post 59 and thus the post constitutes a lever or crank arm for effecting pivotal movement of arm 29 between its first and second positions upon shortening and lengthening of wire 35. Insulative post 59 also serves to electrically insulate wire 35 from arm 29. Thus, upon either an increase or a decrease in ambient temperature from a preselected reference temperature (i.e., from normal room temperature), bimetal finger 56 flexes (as shown in FIGS. 5 and 6) to cause post 57 to pivot in the pivot axis of springs 31 toward and away from wall 15 so as to lengthen and shorten the effective length of wire 35 and to maintain the wire under substantially uniform tension in a manner similar to bracket 49 as heretofore described.

It will be appreciated that in an actuator system as above described, but without device compensation DC or DC′, wire 35 will have a nominal tension and length when stretched by springs 31 at normal room temperature. This nominal length is illustrated in solid lines in FIG. 3 and in FIG. 4. If the actuator in an uncompensated actuator system is exposed to ambient temperaturres below normal room temperature, the length of the wire will increase thus relaxing its nominal tension. As the actuating wire tension lessens, springs 31 will increase the contact pressure between contacts 21 and 27. Thus, in order to insure actuation of the system, the current supplied to the actuator wire at cold ambient temperatures must be sufficient to heat the wire to an actuation temperature which causes the tension in the wire to overcome the bias of springs 31 and to move arm 29 to its second position. On the other hand, at ambient temperatures above normal room temperature, the shape-memory characteristics of wire 35 cause an increase in tension in the wire. This increase in tension may be sufficient to overcome or to partially overcome the bias of springs 31 and to relieve contact pressure between contacts 21 and 27 which may cause the contacts 21 and 27 to creep apart or intermittently make and break. This may cause arcing between the contacts thus shortening the operating life of the relay. Also, if at high ambient temperatures the current level required to heat the wire from cold ambient temperatures to its actuation temperature is applied to the wire, a greater increase in tension in the wire may be effected than is required to overcome the bias of springs 31. Thus, even after arm 29 has been moved to its second position, the temperature to which the wire is heated at high ambient temperatures may result in such a decrease in length of wire 35 that its corresponding tension exceeds the ultimate tensile strength of the wire and causes it to be overstressed leading to failure of the actuator system.

With compensation means DC or DC′, the tension in the wire is maintained substantially constant regardless of changes in ambient temperature. Upon a decrease in ambient temperature, the contact pressure between contacts 21 and 27 remains substantially the same. Thus, the current level supplied to wire 35 need only cause the wire to shorten an amount sufficient to effect an increase in tension in the wire to overcome the constant contact pressure on the contacts and need not overcome a greater contact pressure as may be experienced with uncompensated actuator systems as above described. In other words, at cold ambient temperatures wire 35 need not be heated to as high a temperature to effect actuation and the actuacting current at low ambient temperatures need not be as great as in uncompensated systems. Thus, in device compensated actuator systems of this invention a constant actuating current level may be used which is sufficient to insure that the required change in tension in the wire is effected at cold ambient temperatures, but which prevents the wire from being overstressed when actuated at high ambient temperature levels.

Figure 9:
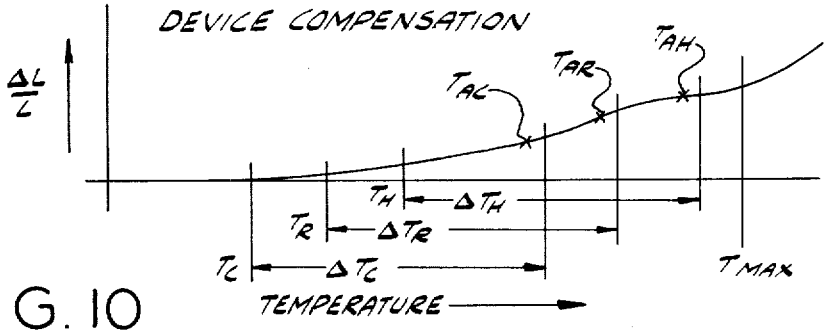
FIGS. 9–11 are curves illustrating the activity of the actuating wire as a function of temperature.
Figure 10:
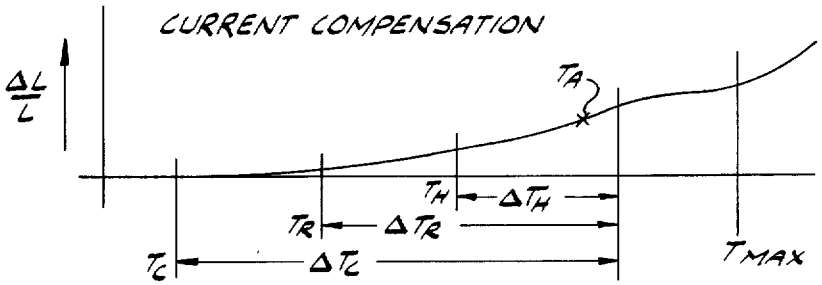
Figure 11:
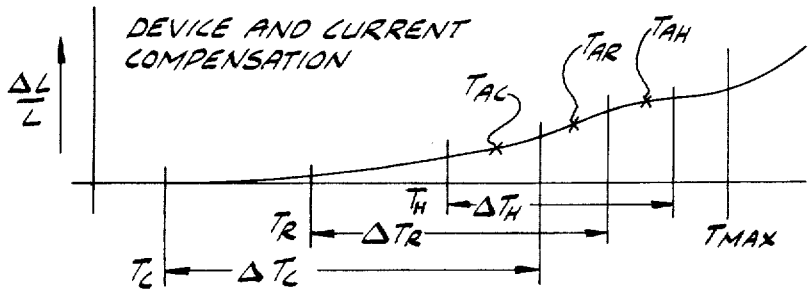

In FIGS. 9–11, graphs present the activity of wire 35 as a function of the change in length per unit length of the wire, expressed as $\Delta L/L$, and temperature. In these graphs, cold ambient temperature, normal room temperature and high ambient temperature are indicated at $T_C$, $T_R$ and $T_H$, respectively, As previously mentioned, with device compensation means DC or DC', the initial or nominal tension in wire 35 is maintained constant as ambient temperature varies so that only a constant change in tension need be induced in the wire to cause actuation of the actuator system. By applying a constant current level to wire 35, the wire is heated through a substantially constant increase in temperature which in turn causes a change in length (i.e., shortening) of the wire to occur with a consequent increase in tension, regardless of the initial temperature of the wire. In FIG. 9, for example, it is seen that by applying a constant current level to actuate wire 35 of a device compensated actuator system 3, the temperature of the wire is increased generally equal temperature changes, as indicated at $\Delta T_C$, $\Delta T_R$ and $\Delta T_H$, and that the system will actuate at one actuation temperature $T_{AC}$ at cold ambient temperature $T_C$, at another actuation temperature $T_{AR}$ at normal room temperature $T_R$, and at another actuation temperature $T_{AH}$ at high ambient temperature $T_H$.

Figure 7:
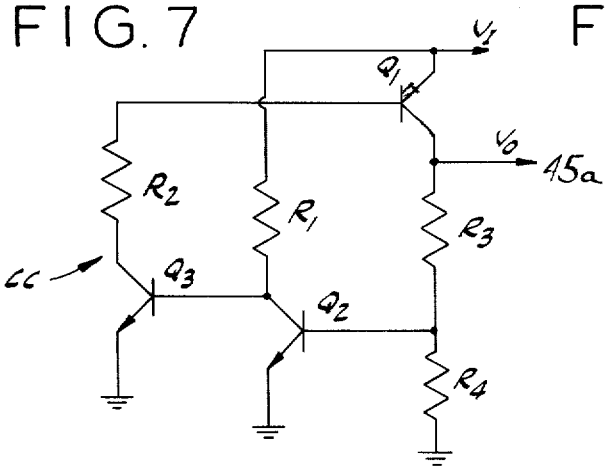
FIGS. 7 and 8 are schematic diagrams of different control circuits for the actuator system of this invention which compensates the current level supplied to the actuator wire in response to changes in ambient temperature.
Figure 8:
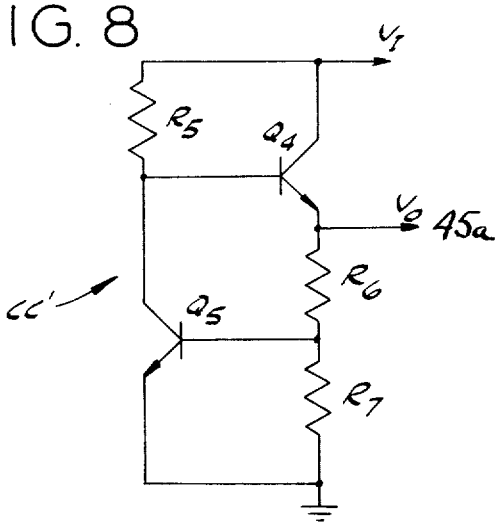

Also in accordance with this invention, temperature compensation for actuator system 3 may be effected by varying the current supplied to actuator wire 35 in response to changes in ambient temperature, this being referred to as current compensation. As shown in FIGS. 7 and 8, two different embodiments of an ambient temperature compensation control circuit, as indicated at CC and CC', respectively, are shown for increasing the level of the actuating current supplied to wire 35 upon a decrease in ambient temperature below a predetermined reference temperature (i.e., below normal room temperature) and for decreasing the level of the actuating current upon an increase in ambient temperature whereby the level of electrical power supplied to the wire varies as a function of ambient temperature.

Referring now to circuit CC shown in FIG. 7, an input voltage $V_I$ is supplied to the emitter of transistor Q1 and the collector of transistor Q2. The emitter of transistor Q2 is grounded and a resistor R1 interconnects the emitter of transistor Q1 and the collector of transistor Q2. The collector voltage of transistor Q2 biases another transistor Q3, the emitter of which is grounded and the collector of which is connected to the base of transistor Q1 through a resistor R2. The collector voltage of transistor Q1 biases the base of transistor Q2 through a voltage divider network composed of resistors R3 and R4. The output voltage $V_O$ is the collector voltage of transistor Q1 and is connected to one terminal 45*a* or 45*b*, the other terminal being connected to ground. The base-emitter voltage of transistor Q2 has a negative temperature coefficient so that the circuit CC supplies more current to wire 35 at lower ambient temperatures than at higher ambient temperatures.

Referring now to FIG. 8, circuit CC', like circuit CC, is also useful for increasing the current level of the control current supplied to wire 35 at low ambient temperatures and for decreasing the current level supplied to the wire at high ambient temperatures. More particularly, the input voltage $V_I$ is supplied to the collector of transistor Q4 of circuit CC' via a resistor R5 to the base of transistor Q4 and the collector of transistor Q5. The emitter of transistor Q5 is grounded. The emitter voltage of transistor Q4 biases the base of transistor Q5 through a voltage divider network composed of resistors R6 and R7. The output voltage $V_O$ is taken from the emitter of transistor Q4. The base-emitter voltage of transistor Q5, like transistor Q2 in the above-described circuit CC, has a negative temperature coefficient for increasing the current level of the actuating current upon decreases in ambient temperature and for decreasing the current level upon increases in ambient temperature.

It will be understood that if current compensation circuits CC or CC'are used, the actuator system 3 would preferably be similar to the actuator system shown in FIG. 4, with the exception that bimetal finger 56 would be omitted. Thus, upon changes in ambient temperature, the tension in wire 35 will vary such that at low ambient temperatures the tension in wire 35 decreases and at high temperatures it increases. At low ambient temperatures, transistor Q2 of circuit CC or transistor Q5 of circuit CC', having negative temperature coefficients, acts to increase the actuating current at low ambient temperature levels and to decrease the actuating current level at high ambient temperature levels so as to insure actuation of the relay at low ambient temperatures and to prevent overstressing of wire 35 when actuated at high ambient temperatures. As previously mentioned, by energizing wire 35 of such an otherwise uncompensated system at high ambient temperature levels with the same current level as used at normal ambients, it may be heated substantially above its actuation temperature and exceed $T_{max}$ which may cause the tension of the wire to increase to such a level as to result in overstressing (i.e., inelastic yielding) of the wire with consequent failure of the relay. In FIG. 10 it is seen that by utilizing current compensation circuits CC or CC', wire 35 is heated to substantially the same temperature which is somewhat above its actuating temperature $T_A$ (but not approximating $T_{max}$) for all ambient temperatures between $T_C$ and $T_H$. The temperature change $\Delta T_C$ of the wire is greater than $\Delta T_R$ which in turn is greater than $\Delta T_H$. These temperature changes are generally proportional to the square of the current supplied to the wire and thus it can be seen how current compensation circuits CC and CC' are responsive to changes in ambient temperature. By limiting the temperature to which the wire is heated, overstressing of the wire is prevented, but proper actuation is assured even at low ambients.

It will also be understood that ambient compensation means of this invention may also be accomplished by a combination of both device compensation means DC or DC' and current compensation circuits CC or CC'. Stated in another way, ambient temperature compensation means of this invention does one or both of the following: It varies the length of wire 35 so as to maintain the wire under substantially constant tension regardless of changes in ambient temperature, and/or it varies the level of current supplied to the wire for self-heating the wire to effect an increase in tension therein sufficient to move the actuator arm from its first to its second position and to prevent the wire from being heated above its maximum temperature $T_{max}$ so as to prevent permanent damage to the wire.

In FIG. 11, the effects of combined device compensation and current compensation are shown in relation to wire activity. It will be noted that device compensation means maintains wire 35 under substantially constant tension, and that the actuation temperature of the wire varies between $T_{AC}$ at cold ambient temperatures, $T_{AR}$ at normal ambient temperatures, and $T_{AH}$ at high ambient temperatures. It will also be noted that due to changes in the current level supplied to the wire at various ambient temperatures by current compensation circuits CC or CC', the temperature change through which wire 35 is heated at various ambient temperature levels varies. Thus, as in FIG. 10, wire temperature change $\Delta T_C$ at cold ambient temperature levels is greater than the temperature change of the wire at normal room or elevated ambient temperatures $\Delta T_R$ and $\Delta T_H$, respectively. Also, with combined device and current compensation, the ambient temperature range over which actuator system 3 is compensated is greater than the range of either device or current compensation along. For example, combined device and current compensation will compensate for temperatures ranging between −40° F. (−40°C.) and 240°F. (115°C.), whereas either device or current compensation alone may only compensate for ambient temperatures ranging between 0°F. (−18°C.) and 160°F. (71°C.).

In view of the above, it will be seen that the several objects of the invention are achieved and other advantageous results attained.

It should be understood that various modifications of the disclosed embodiments can be made within the scope of this invention. For example, the bimetal finger 56 shown in FIGS. 4–6 can be proportioned to apply a selected "contact preload force" to the arm 29 so that, when the contact 27 is initially engaged with the contact 25 during closing of the described circuit, the engagement of the contacts tends to release the force on arm 29 applied by the finger 56 to enhance pressure between the contacts 27 and 25. Such a force applied by finger 56 can also aid in separating contacts 27 and 25 during circuit opening if contact sticking should occur. Similarly a monometal member like finger 56 could be incorporated in the device of FIGS. 1–3 to apply a similar "contact preload force" to the arm 29 in that device. Similarly, the insulative spacer 47 could be omitted from the device 1 of FIGS. 1—3 and the bracket 49 could be mounted directly on the arm 29, the wire 35 then requiring an insulative wrap or the like to insulate the wire from the bracket 49. The disposition of the bracket 49 could also be reversed to accommodate the same length of wire 35 in a device 1 of smaller overall length. Also, a small metal washer or the like could be secured between the bracket 49 and the arm 29 to minimize interference with movement of the torsion members 31 by the bracket 49. As various changes could be made in the above constructions without departing from the scope of the invention, it is intended that all matter contained in the above description or shown in the accompanying drawings shall be interpreted as illustrative and not in a limiting sense.

What is claimed is:

1. An actuator system comprising a frame, an actuator member carried by said frame movable between a first position and a second position, means biasing said actuator member toward its first position, a wire coupling said frame and said actuator member, said wire being tensioned by said biasing means so as to be stretched from an original length to a second length when the actuator member is in its first position, said wire being of a selected metal alloy which upon being heated shortens its length and increases tension in the wire to overcome the bias of the biasing means to move the actuator member from its first to its second position, means for selectively heating the wire to effect said increase in wire tension, and ambient temperature compensation means comprising a bimetallic member secured to said actuator member, said bimetallic member being adapted to flex in response to changes in ambient temperature thereby to maintain the wire under substantially uniform tension during changes in ambient temperature, whereby upon selective heating of said wire to effect said increase in wire tension to move the actuator member to its second position, it is sufficiently heated to effect movement of said actuator member from its first to its second position without overstressing the wire.

2. An actuator system as set forth in claim 1 wherein said means for selectively heating said wire comprises control circuit means selectively operable to pass an electrical current through the wire, said control circuit including means in said control circuit for increasing the level of said current supplied to the wire upon a decrease in ambient temperature below a predetermined reference temperature and for decreasing the level of said current upon an increase in ambient temperature above said reference temperature.

3. An actuator system comprising a frame, an actuator member carried by said frame movable between a first position and a second position, means biasing said actuator member toward its first position, a wire coupling said frame and said actuator member, said wire being tensioned by said biasing means so as to be stretched from an original length to a second length when the actuator member is in its first position, said wire being of a selected metal alloy which upon being heated shortens its length and increases tension in the wire to overcome the bias of the biasing means to move the actuator member from its first to its second position, control circuit means selectively operable to pass an electrical current through the wire for selectively heating the wire to effect said increase in wire tension, and ambient temperature compensation means comprising means in said control circuit for increasing the level of said current supplied to the wire upon a decrease in ambient temperature below a predetermined reference temperature and for decreasing the level of said current upon an increase in ambient temperature above said reference temperature whereby the level of electrical power supplied to the wire varies as a function of ambient temperature.

4. An actuator system as set forth in claim 3 wherein said means in said control circuit comprises at least one temperature sensitive device having a negative temperature coefficient.

5. An actuator system as set forth in claim 3 wherein said wire is of such cross sectional area and length as to be heated for effecting said change in tension of said wire by passing an electrical current therethrough with a power input of less than about two watts for effecting operation of said actuator system at power levels used in energizing integrated circuits.

6. An actuator system comprising a frame, an elongate arm carried by said frame and generally pivotably movable about a pivot axis between first and second positions, means biasing said arm toward its first position, a support cantilevered from said arm adjacent said pivot axis, a wire having one end secured to the free end of said support coupling said arm to said frame, said wire being tensioned by said biasing means so as to be stretched from an original length to a second length when the arm is in its first position, said wire being of a selected metal alloy which upon being heated shortens its length and increases the tension in the wire to overcome the bias of said biasing means to move said arm from its first to its second position, a control circuit connected to said wire for selectively energizing the wire, as by passing an electrical current therethrough, so as to self-heat the wire to effect said increase in wire tension and to effect said movement of the arm from its first position to its second position, and an elongate bimetallic member having one end thereof secured to said arm adjacent said pivot axis and extending lengthwise of said arm, said bimetallic member having a portion thereof spaced from said one end thereof engageable with said arm so that said bimetallic member is spaced from said arm substantially along its length and so that said portion is in engagement with said arm, whereby upon a decrease or an increase in ambient temperature from a predetermined reference ambient temperature said bimetallic member flexes so as to cause said support to pivot on said pivot axis to thus maintain said wire under substantially uniform tension during such ambient temperature changes and whereby upon passing a current of predetermined value through said wire to effect said self-heating of the wire, the wire is sufficiently heated to effect movement of the arm from its first to its second position without overstressing the wire.

7. An actuator system as set forth in claim 6 wherein said bimetallic member has its high expansion side facing away from said arm.

8. An actuator system comprising a frame, an actuator member carried by said frame movable between a first position and a second position, means biasing said actuator member toward its first position, a wire coupling said frame and said actuator member, said wire being tensioned by said biasing means so as to be stretched from an original length to a second length when the actuator member is in its first position, said wire being of a selected metal alloy which upon being heated shortens its length and increases tension in the wire to overcome the bias of the biasing means to move the actuator member from its first to its second position, means for selectively heating the wire to effect said increase in wire tension, and a bimetallic ambient temperature compensating member secured to said actuator member and adapted to flex in response to changes in ambient temperature to maintain the wire under substantially uniform tension during changes in ambient temperature whereby, upon selective heating of said wire to effect said increase in wire tension to move the actuator member to its second position, the wire is sufficiently heated to effect such movement of the actuator member to its second position without overstressing the wire, said actuator member comprising an elongate arm generally pivotally movable about a pivot axis between its first and second positions, and said bimetallic member being cantilevered from said arm adjacent said axis and having said wire coupled to its free end, said bimetallic member flexing toward the one end of the wire secured to said body upon increases in ambient temperature above a predetermined reference temperature and flexing in opposite direction upon decreases in ambient temperature below said reference temperature thereby to maintain the wire under said substantially uniform tension during said ambient temperature changes.

9. An actuator system as set forth in claim 8 wherein said bimetallic member has its high expansion side facing away from said one end of the wire for flexing generally in the longitudinal direction of the wire.

10. An actuator system comprising a frame, an actuator member carried by said frame movable between a first position and a second position, means biasing said actuator member toward its first position, a wire coupling said frame and said actuator member, said wire being tensioned by said biasing means so as to be stretched from an original length to a second length when the actuator member is in its first position, said wire being of a selected metal alloy which upon being heated shortens its length and increases tension in the wire to overcome the bias of the biasing means to move the actuator member from its first to its second position, means for selectively heating the wire to effect said increase in wire tension, said heating means comprising a control circuit connected to said wire for selectively energizing the wire by passing an electrical current therethrough to self-heat the wire to effect movement of the actuator member from its first to its second position, and ambient temperature compensation means comprising a bimetallic member secured to said actuator member, said bimetallic member being adapted to flex in response to changes in ambient temperature thereby to maintain the wire under substantially uniform tension during changes in ambient temperature, whereby upon passing a current of predetermined value through said wire to effect said increase in wire tension to move the actuator member to its second position, it is sufficiently heated to effect movement of said actuator member from its first to its second position without overstressing the wire.

11. In a relay system as set forth in claim 10 wherein said wire is of such cross sectional area and length so as to be heated for effecting said change in tension by passing a current therethrough with a power input of less than about two watts for effecting operation of said relay system at power levels used in energizing integrated circuits.

12. An actuator system comprising a frame, an actuator member carried by said frame movable between a first position and a second position, means biasing said actuator member toward its first position, a wire coupling said frame and said actuator member, said wire being tensioned by said biasing means so as to be stretched from an original length to a second length when tne actuator member is in its first position, said wire being of a selected metal alloy which upon being heated shortens its length and increases tension in the wire to overcome the bias of the biasing means to move the actuator member from its first to its second position, means for selectively heating the wire to effect said increase in wire tension, said heating means comprising a control circuit connected to said wire for selectively energizing the wire by passing an electrical current therethrough to self-heat the wire to effect movement of the actuator member from its first to its second position, and ambient temperature compensation means comprising a bimetallic member secured to said actuator member, said bimetallic member being adapted to flex in response to changes in ambient temperature thereby to maintain the wire under substantially constant tension during changes in ambient temperature, and means in said control circuit for increasing the power input of said current supplied to the wire upon a decrease in ambient temperature below a predetermined reference temperature and for decreasing the level of said current upon an increase in ambient temperature above said reference temperature.

13. In a relay system having an insulating frame, stationary contact means on the frame, a contact arm pivotally movable about a pivotal axis, a movable contact carried by said arm engageable with said stationary contact means, said arm being movable between a closed circuit position in which said movable contact is in engagement with said stationary contact means for completing a circuit and a circuit breaking position in which said movable contact is clear of said stationary contact means, means biasing said arm toward one of its stated positions, a wire coupling said frame and arm, said wire being tensioned by said biasing means to as to be stretched from an original length to a second length when said contact arm is in its stated one position, said wire being of a selected metal alloy which upon being heated shortens its length and thus causes the tension in the wire to increase an amount sufficient to overcome the bias of said biasing means and to move said arm from its said other position, means for selectively heating the wire to effect said increase in tension in the wire, said heating means comprising a control circuit connected to said wire for selectively energizing the wire, as by passing an electrical current therethrough, so as to self-heat the wire and to effect movement of said arm against the biasing of said bias means from said one to said other position, and ambient temperature compensation means comprising a bimetallic member secured to said arm and being adapted to flex in response to changes in ambient temperature so as to maintain the wire under substantially uniform tension, whereby passing a current of predetermined value through said wire effects a sufficient increase in temperature of the wire to effect movement of said arm from its said one to its other position without overstressing the wire.

14. In a relay system as set forth in claim 13 wherein said arm is pivotally movable about said pivot axis between its closed and circuit-breaking positions, and wherein said relay system further comprises a support cantilevered from said arm adjacent said pivot axis, one end of said wire being coupled to the free end of said support, said bimetallic member being an elongate member rigidly secured at one end thereof to said arm adjacent said pivot axis and extending lengthwise of the arm, said bimetallic member having a portion thereof spaced from said one end thereof engageable with said arm so that said bimetallic member is spaced from said arm substantially along its length and so that said portion is in engagement with said arm, whereby upon a change in ambient temperature from a predetermined reference temperature, said bimetallic member flexes so as to cause said support to pivot on said pivot axis and to thus vary said second length of wire and to maintain said wire under substantially uniform tension.

15. In a relay system as set forth in claim 14 wherein said bimetallic member has its high expansion side facing away from said arm.

16. In a relay system as set forth in claim 13 wherein said arm is pivotally movable about said pivot axis between its closed and circuit-breaking positions, and wherein said bimetallic member is cantilevered from said arm adjacent said pivot axis and has said wire coupled to its free end, said bimetallic member flexing toward the one end of the wire secured to said frame upon increases in ambient temperature above a predetermined reference temperature and flexing in opposite direction upon decreases in ambient temperature below said reference temperature thereby to vary said second length of said wire and thus maintain the wire under substantially uniform tension.

17. In a relay system as set forth in claim 16 wherein said bimetallic member has its hiigh expansion side facing away from said one end of the wire for flexing generally in the longitudinal direction of the wire.

18. In a relay system as set forth in claim 16 wherein electrical insulation is provided between said wire as it is secured to said bimetallic member and said arm for electrically insulating said wire from said arm.

19. In a relay system as set forth in claim 16 wherein said bimetallic member is of sufficient stiffness so as to substantially prevent bending thereof upon said wire being heated to a temperature sufficient to effect movement of said arm.

20. In a relay system as set forth in claim 17 wherein said bimetallic member is wide in relation to the distance it is cantilevered from said arm thereby to insure it flexes generally in the longitudinal direction of the wire in response to changes in ambient temperature.

21. In a relay system as set forth in claim 13 wherein said control circuit includes means in said control circuit for increasing the level of said current supplied to said wire upon a decrease in ambient temperature below a predetermined reference temperature and for decreasing the level of said current upon an increase in ambient temperature above said reference temperature.

* * * * *